US007435109B1

(12) United States Patent
Sugiura

(10) Patent No.: US 7,435,109 B1
(45) Date of Patent: Oct. 14, 2008

(54) SPRING CONNECTOR

(75) Inventor: Kenta Sugiura, Arlington Heights, IL (US)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 11/987,010

(22) Filed: Nov. 26, 2007

(51) Int. Cl.
*H01R 12/00* (2006.01)

(52) U.S. Cl. ..... 439/83; 439/700

(58) Field of Classification Search ..... 439/78, 439/79, 83, 84, 700
See application file for complete search history.

(56) References Cited

U.S. PATENT DOCUMENTS 3,406,368 A * 10/1968 Curran ..... 439/79
4,966,556 A * 10/1990 Reymond et al. ..... 439/80
5,509,813 A * 4/1996 Lu ..... 439/79
5,941,739 A * 8/1999 Yoo ..... 439/840

FOREIGN PATENT DOCUMENTS

JP 2000-195600 7/2000
JP 2003-264029 9/2003
JP 2004-55243 2/2004

* cited by examiner

*Primary Examiner*—Khiem Nguyen
(74) *Attorney, Agent, or Firm*—Morgan, Lewis & Bockius LLP

(57) ABSTRACT

A spring connector includes: an electrically-conductive pin; an electrically-conductive tube, having the pin slidably received therein, the tube holding the pin in such a condition that at least part of the pin projects from one end of the tube in a first direction, and the other end of the tube being open; and a housing, including a hole portion which can receive the tube, and a slit exposing at least part of an outer peripheral surface of the tube to an exterior, the housing having a first wall portion opposed to the other end of the tube and formed with a projecting portion projecting in the first direction and fitting to the other end of the tube. The at least part of the outer peripheral surface of the tube which is exposed from the slit is electrically connectable to a board.

8 Claims, 5 Drawing Sheets

A-A

B-B

SPRING CONNECTOR

BACKGROUND OF THE INVENTION

This invention relates to a connector used in an electronic equipment such as a cellular phone, and particularly to a right angle-type spring connector mounted horizontally on a board.

A cellular phone contains a battery as a main power source, and this battery and an equipment body are electrically connected together via a spring connector mounted on a printed wiring board of the equipment body.

With the achievement of a low profile design of cellular phones in recent years, there has been an increasing demand for a low-profile design of the spring connector.

A spring connector 100 of the related art is shown in FIGS. 10 and 11.

The spring connector 100 of the related art is surface mounted on a board 200, and in FIG. 10, 60 denotes a resin-made insulative housing, 70 denotes a tube made of an electrically-conductive material, 30 denotes a pin, and 40 denotes a spring. Within the housing 60, the plurality of pins 30 having electrical conductivity and serving as contacts are received, together with the respective springs 40, in the respective tubes 70.

As shown in FIG. 10, the pin 30 is urged by the spring 40, and is held in such a condition that its distal end is projected from an open end portion of the tube 70. After the spring 40 and the pin 30 are inserted into the tube 70, the open end portion of the tube 70 from which the pin 30 projects is press-deformed. Therefore, the pin 30 can slide within the tube 70, but will not escape from the tube 70 to the exterior.

Hole portions 61 for the insertion and holding of the respective tubes 70 are provided in the housing 60, and the tube 70 in which the pin 30 and the spring 40 are received and held therein is inserted into this hole portion 61. A holding portion 62 is provided at the hole portion 61, and is formed such that it projects radially inwardly in the hole portion 61. A diameter (hole diameter) of this holding portion 62 is smaller than an outer diameter of a receiving portion 71 of the tube 70, which is a portion on this tube for receiving the holding portion 62 when the tube 70 is inserted into the hole portion 61. Therefore, the tube 70 is press-fitted into the hole portion 61 of the housing 60, and is held therein. FIG. 11 is a transverse cross-sectional view showing this holding portion 62 and the receiving portion 71. As shown in FIG. 11, the holding portion 62 is so formed as to cover the receiving portion 71 in a peripheral direction so that the tube 70 will not fall from the housing 60 in a downward direction.

In the spring connector 100 of the related art, the following construction has been introduced in order to achieve its low-profile design.

Slits 63 communicating respectively with the hole portions 61 are formed in a lower portion of the housing 60, and the tube 70 inserted into the hole portion 61 is exposed to the exterior of the housing 60 through this slit 63. A mounting portion 72 for electrical connection to the board 200 is formed on an outer peripheral surface of the tube 70, and the mounting portion 72 exposed from the slit 63 is connected by soldering or the like to a land (not shown) formed on the board 200. Therefore, the height of the spring connector 100 on the board 200 is reduced in an amount corresponding to a saved lower portion of the housing 60 that is eliminated by such construction.

However, the following problems may occur in the spring connector 100 of the related art.

In the press-fit holding structure in which the diameter of the holding portion 62 of the housing 60 is set to a size smaller than the outer diameter of the receiving portion 71 of the tube 70, thereby holding the tube 70, deformation as shown in FIG. 11 develops in the housing 60 because of the existence of the slits 63 formed in the lower portion of the housing 60 and of stresses produced by the press-fitting. Namely, when the stresses are applied to an upper portion of the housing 60, which also has the slits 63 in its lower portion, this results in a problem in that the lower portions of the slits 63 are widened, so that the whole of the housing 60 is warped upwardly.

On the other hand, when the housing 60 holding the tubes 70 is solder mounted on the board 200, solder is coated on the lands on the board 200, and thereafter the housing 60 is mounted on the board 200, with the mounting portions 72 of the tubes 70 being exposed from the respective slits 63, and the soldering is then effected by heating. Accordingly, there is also a fear that the housing 60 may be further deformed by the influence of heat during the heating.

With the thus deformed housing 60, its stable electrical connection to the board 200 can not be obtained. To avoid this deformation, it is necessary to thicken the upper portion of the housing 60 (the portion disposed above the hole portions 61), and therefore this leads to a drawback in that the overall height of the spring connector becomes large.

SUMMARY

It is therefore an object of the invention to provide a spring connector in which a thickness of an upper portion of a housing can be made thinner through provision of a normal holding structure that eliminating deformation of the resin housing, thereby achieving a low-profile design of the whole of the spring connector.

In order to achieve the object, according to the invention, there is provided a spring connector comprising:

an electrically-conductive pin;

an electrically-conductive tube, having the pin slidably received therein, the tube holding the pin in such a condition that at least part of the pin projects from one end of the tube in a first direction, and the other end of the tube being open; and a housing, including a hole portion which can receive the tube, and a slit exposing at least part of an outer peripheral surface of the tube to an exterior, the housing having a first wall portion opposed to the other end of the tube and formed with a projecting portion projecting in the first direction and fitting to the other end of the tube, wherein the at least part of the outer peripheral surface of the tube which is exposed from the slit is electrically connectable to a board.

DETAILED DESCRIPTION OF PREFERRED EMBODIMENTS

Figure 1:
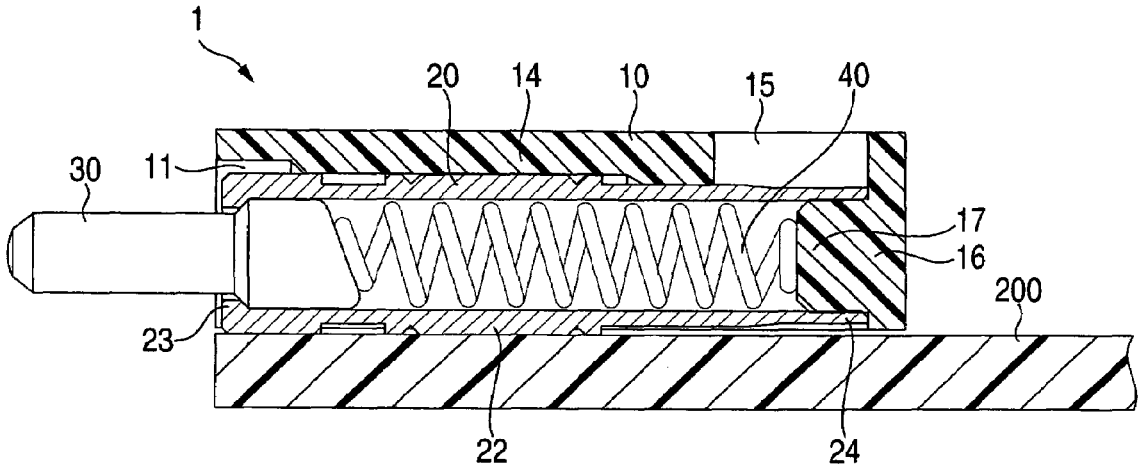
FIG. 1 is a schematic view showing a first embodiment of a spring connector of the present invention.

Embodiments of the present invention will now be described with reference to FIGS. 1 to 9. The same construction as that of the above-mentioned related art will be designated by identical reference numerals, and explanation thereof will be omitted.

Figure 2:
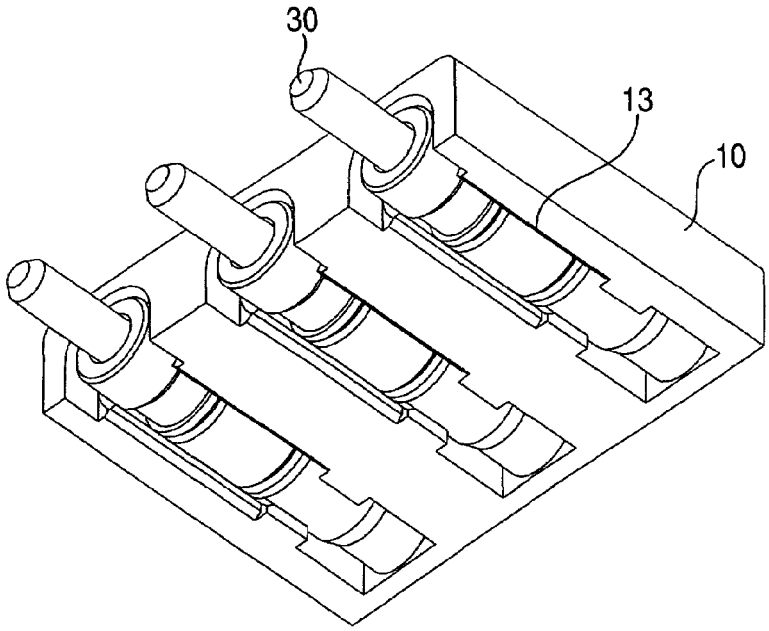
FIG. 2 is an external perspective view of the first embodiment of the spring connector of the present invention.

FIG. 1 is a schematic view of a first embodiment of a spring connector of the present invention, and FIG. 2 is an external perspective view. In the spring connector 1 in the drawings, 10 denotes a resin-made insulative housing, 20 denotes a tube made of an electrically-conductive material, 30 denotes a pin, and 40 denotes a spring.

Hole portions 11 into which the tubes 20 can be inserted, respectively, are provided in the housing 10, and slits 13 communicating respectively with the hole portions 11 are provided in a lower portion of the housing 10, and the tube 20 inserted in the hole portion 11 is held within the housing 10 in such a condition that a mounting portion 22 formed on a generally longitudinally-central portion of an outer peripheral surface of the tube is exposed from the slit 13.

The mounting portion 22 of the tube 20 exposed from the slit 13 in the housing 10 is connected by soldering to a land provided on a board 200, so that the pin 30, the tube 20 and the board 200 are electrically connected together.

The pin 30 is slidably received within, the tube 20, and is urged in a forward direction (left direction in FIG. 1) by the spring 40 also received within the tube 20. Although a front end of the tube 20 is open so that a distal end of the pin 30 can project therefrom, a narrow portion 23 is formed at this front end so that the pin 30 urged by the spring 40 will not escape to the exterior of the tube 20.

An open end portion 24 is provided at a rear end (the right side in FIG. 1) of the tube 20 so that the pin 30 and the spring 40 can be inserted into the tube 20. Namely, in an assembling process, the pin 30 and the spring 40 are inserted into the tube 20 through the open end portion 24.

Upper open portions 15 corresponding respectively to the hole portions 11 are formed in a rear portion of an upper wall portion 14 of the housing 10, and cylindrical projecting portions 17 also corresponding respectively to the hole portions 11 and projecting forwardly are formed integrally on a rear wall portion 16 of the housing 10. These upper open portions 15 are elements which are required for a mold so that it can form the projecting portions 17 on the rear wall portion 16, that is, within the housing 10. Therefore, a length of projecting of the projecting portion 17 in a direction toward the front side of the housing 10 is smaller than a length of opening of the upper open portion 15 in the same direction.

The tube 20 into which the pin 30 and the spring 40 is inserted through the open end portion 24 is held within the housing 10 as a result of fitting of this open end portion 24 onto the projecting portion 17 of the housing 10. With such structure, the spring 40 is received in a compressed condition within the tube 20, and one end thereof abuts against the projecting portion 17, and the other end thereof urges the pin 30. Therefore, the pin 30 is held in the housing 10 and the tube 20, and can be resiliently moved in the forward and backward directions. Incidentally, an outer diameter of the projecting portion 17 of the housing 10 is larger than an inner diameter of the open end portion 24 of the tube 20, and the open end portion 24 is press-fitted on the projecting portion 17. Therefore, the tube 20 is held in the housing 10 at its rear portion.

Figure 3:
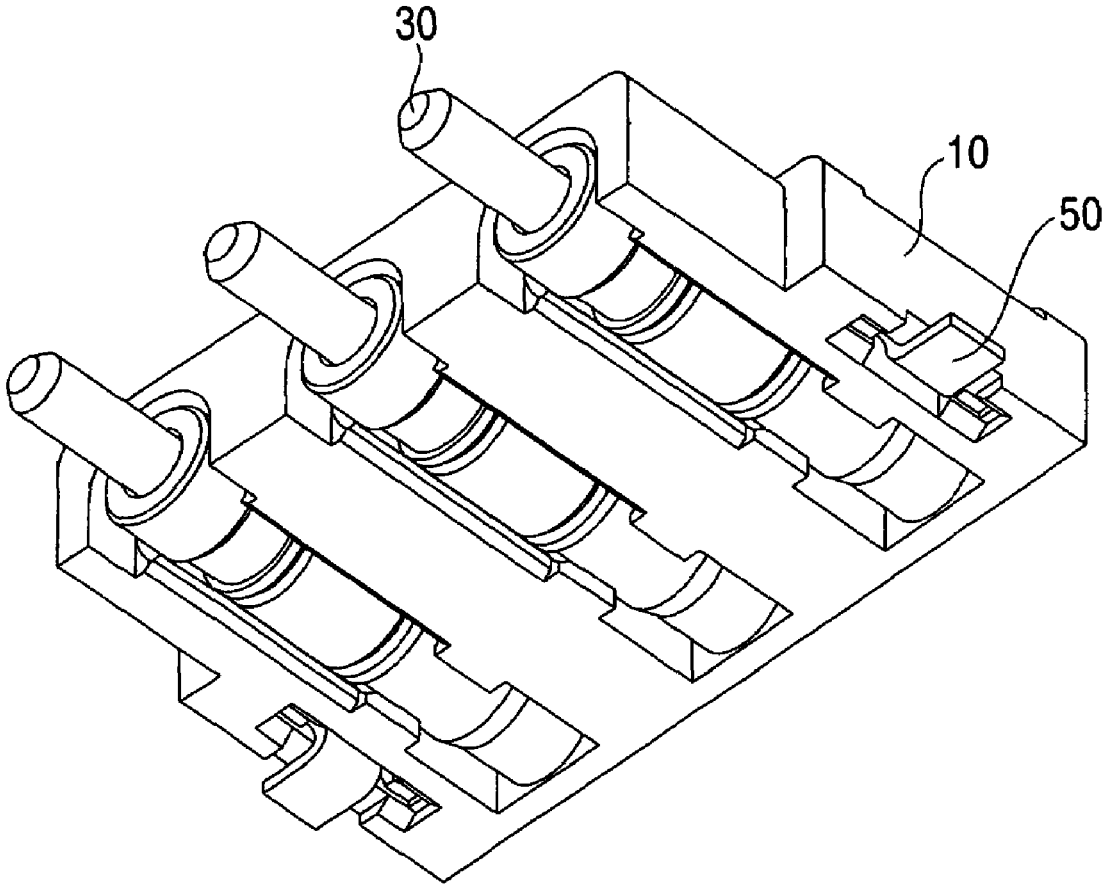
FIG. 3 is an external perspective view showing a modified example of the first embodiment of the spring connector of the present invention.

FIG. 3 shows a modified example of the above-mentioned first embodiment.

In FIG. 3, solder reinforcing terminals 50 are supported respectively on opposite side portions of the housing 10, and are connected by soldering to lands formed on the board 200 in a manner similar to that of the mounting portion 22 of the tube 20. However, unlike the connection between the mounting portion 22 of the tube 20 and the land on the board 200, the connection of the solder reinforcing terminals 50 to the lands is effected only for mounting and fixing purposes, and electrical connection to a circuit, etc., on the board 200 is not made. With the use of the solder reinforcing terminals 50, the more stable solder mounting can be effected.

Figure 4:
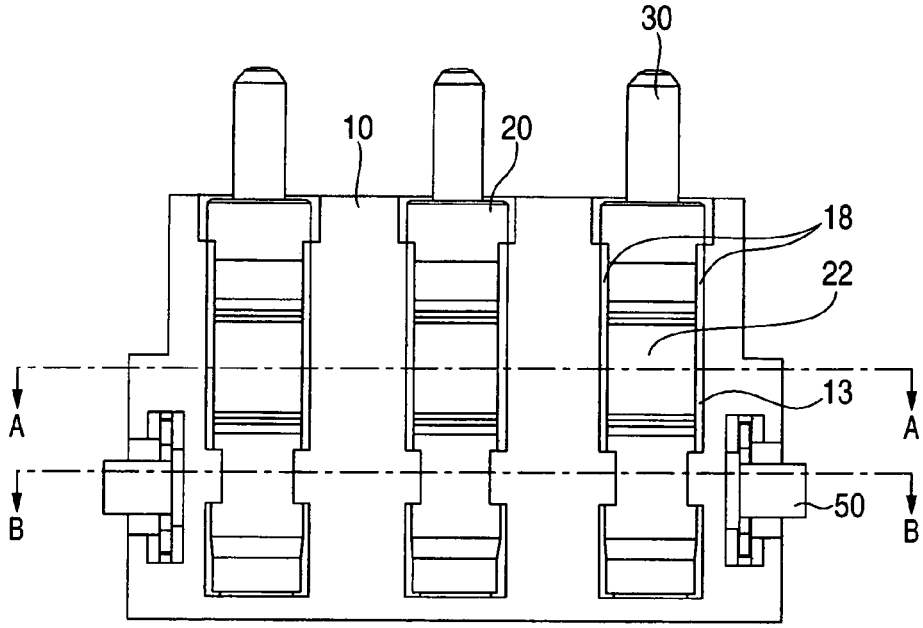
FIG. 4 is a bottom view of the spring connector shown in FIG. 3.

The first embodiment will be described below in further detail using the above-mentioned modified example. FIG. 4 is a bottom view of the modified example of the above-mentioned spring connector 1, and FIG. 5 is a cross-sectional view taken along the line A-A of FIG. 4, and FIG. 6 is a cross-sectional view taken along the line B-B of FIG. 4.

As described above, the slits 13 for the solder mounting of the tubes 20 on the board 200 are formed in the lower portion of the housing 10. Although a width of the slit 13 in its transverse direction (a left-right direction in FIG. 4; a direction perpendicular to a longitudinal direction of the tube 20) needs to be sufficiently large to enable the mounting portion 22 of the tube 20 to be solder bonded to the land on the board 200, this width should be smaller than the diameter of the tube 20, and the width of the slit 13 is so adjusted that the hole portion 11 of the housing 10 can sufficiently cover the outer diameter of the tube 20. In the present invention, the rear open end portion 24 of the tube 20 and the projecting portion 17 at the rear portion of the housing 10 are fitted together, so that the housing 10 thus sufficiently covers the outer diameter of the tube 20 in the longitudinal direction of the tube 20. This prevents the tube 20 from being moved within the housing 10 in an upward-downward direction (in a direction of the sheet plane of FIG. 4).

Figure 5:
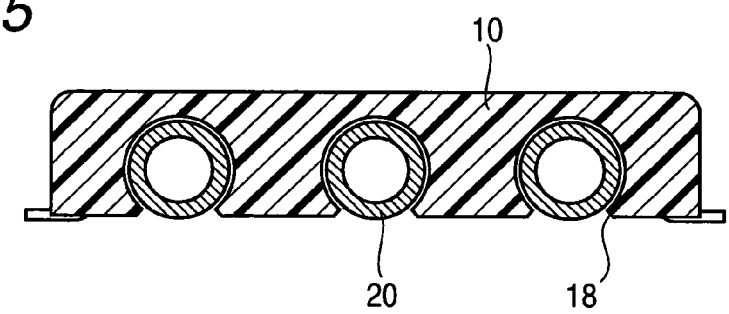
FIG. 5 is a cross-sectional view of the spring connector of FIG. 4 taken along the line A-A.
Figure 6:
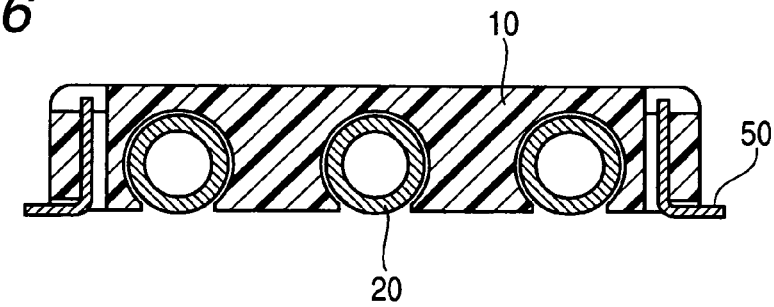
FIG. 6 is a cross-sectional view of the spring connector of FIG. 4 taken along the line B-B.

The cross-section A-A of the spring connector 1 shown in FIG. 5 is a cross-sectional view of a position corresponding to the mounting portions 22 of the tubes 20 as shown in FIG. 4. Namely, the tubes 20 are soldered to the board 200 at the position shown in FIG. 5. On the other hand, the cross-section B-B of the spring connector 1 shown in FIG. 6 is a cross-sectional view of a position corresponding to the solder reinforcing terminals 50 supported on the housing 10, and in this position the tubes 20 are not soldered to the board 200.

As shown in FIG. 5 (and FIG. 4), in the vicinity of the position corresponding to the mounting portion 22 of the tube 20, that is, in the vicinity of the position where the tube 20 and the board 200 are solder bonded together, each opposite sides of the slit 13 are notched to form chamfered portions 18, respectively. If the chamfered portions 18 are not provided respectively at the opposite sides of the slit 13 in the vicinity of the position where the tube 20 and the board 200 are solder bonded together, a phenomenon can occur in which solder beforehand coated on the land on the board 200 contacts the opposite side portions of the slit 13 at the time of mounting the spring connector 1 on the board 200, so that much solder flows out to the opposite side portions of the slit 13 under the influence of surface tension of the solder. In this case, the solder is not sufficiently deposited on the mounting portion 22 of the tube 20, and therefore the strength of bonding between the spring connector 1 and the board 200 is low.

On the other hand, in the position shown in FIG. 6 (and FIG. 4), that is, in the position where the tube 20 and the board 200 are not solder bonded together, the opposite sides of the slit 13 are not chamfered. This is because the phenomenon in which the solder is blocked by the opposite side portions of the slit 13 as described above will not occur in this position and also because no chamfered portion is required in the slit 13 due to the fact that the tube 20 can be held more stably by the hole portion 11 of the housing 10.

Figure 7:
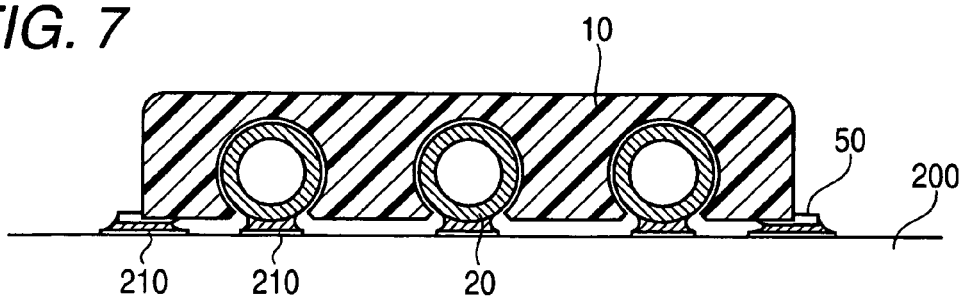
FIG. 7 is a cross-sectional view in the cross-section A-A of FIG. 5, showing a manner of solder mounting.

The manner in which the spring connector 1 is solder mounted on the board 200 is shown in FIG. 7. In FIG. 7, the mounting portions 22 of the tubes 20 and the solder reinforcing terminals 50 are solder bonded respectively to the corresponding lands 210 on the board 200.

In the first embodiment of the present invention, in place of using the press-fit holding structure of the related art according to the difference between the housing inner diameter and the tube outer diameter there is adopted the press-fit holding structure at the rear open end portion 24 of the tube 20 and the projecting portion 17 at the rear portion of the housing 10, and by doing so, stresses will not be transmitted to the portion (the upper wall portion) of the housing 10 disposed above the hole portions 11. Therefore, the deformation of the housing which is the problem with the related art does not occur, and the upper wall portion can be made thinner than that of the related art, and the low-profile design of the whole of the spring connector can be achieved.

Next, a second embodiment of the present invention will be described with reference to FIGS. 8 and 9. The second embodiment is similar in basic construction to the first embodiment, and therefore an identical construction will be designated by identical reference numerals, and explanation thereof will be omitted.

Figure 8:
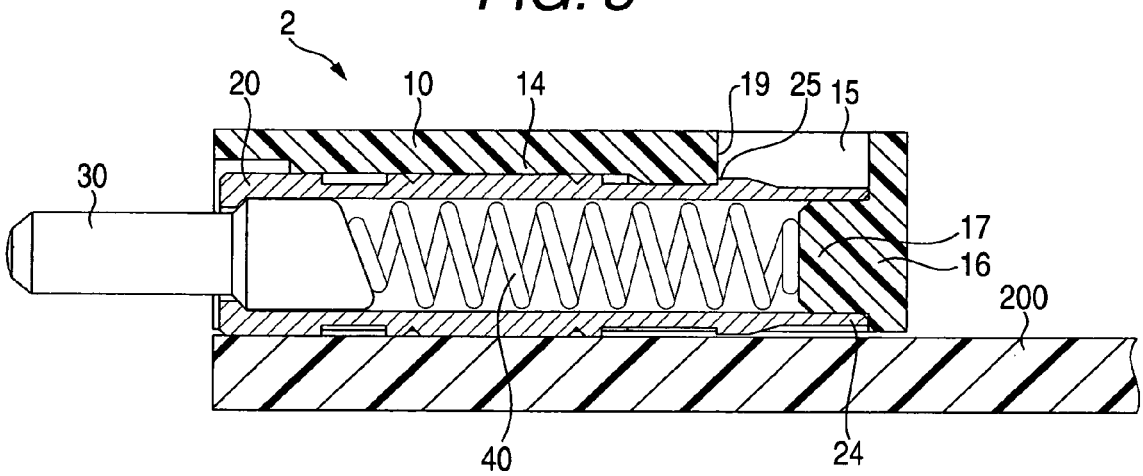
FIG. 8 is a schematic view showing a second embodiment of the present invention.
Figure 9:
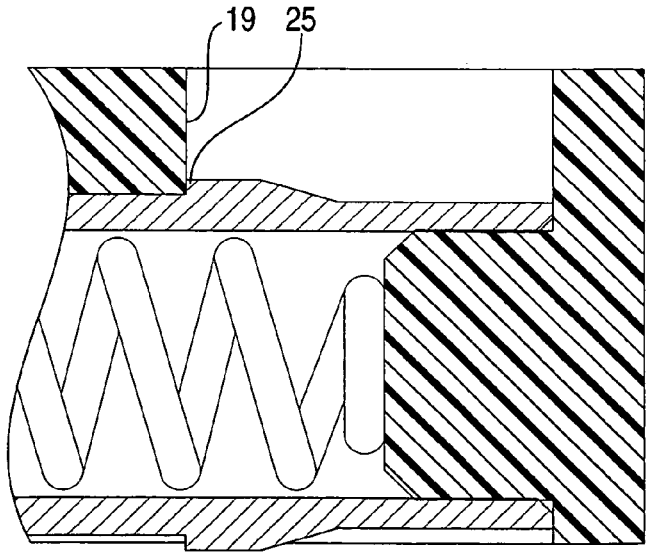
FIG. 9 is an enlarged view of the present invention, showing portions surrounding a retaining portion of a tube shown in FIG. 8
Figure 10:
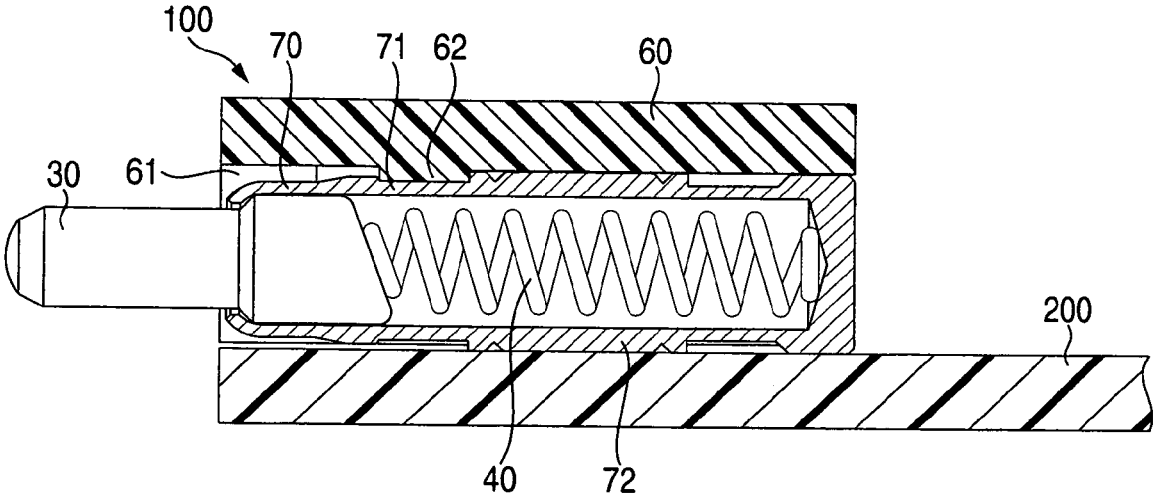
FIG. 10 is a schematic view showing a structure of a spring connector of the related art.
Figure 11:
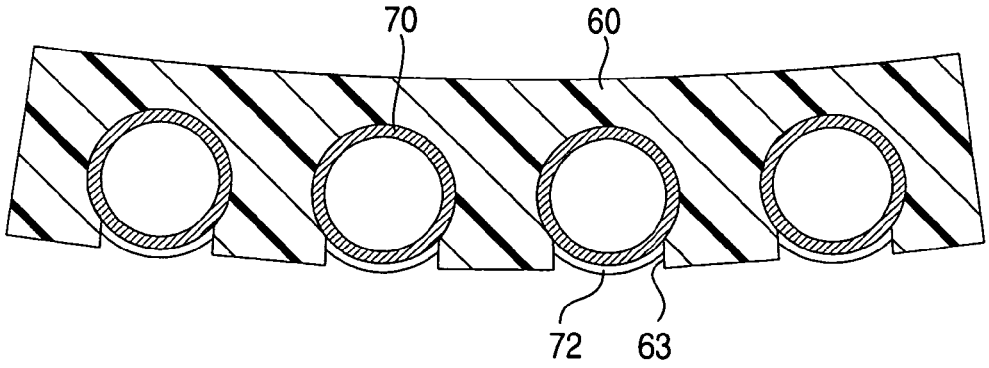
FIG. 11 is a transverse cross-sectional view showing holding portions of a housing and receiving portions of tubes shown in FIG. 10.

FIG. 8 is a schematic view of a spring connector 2. In the spring connector 2, in addition to the construction of the spring connector 1 of the first embodiment, an engagement portion 25 which projects radially outwardly from a tube 20 is formed at a rear portion of a tube 20, which corresponds to an upper open portion 15 of a housing 10 when the tube 20 is inserted into a hole portion 11 of the housing 10. The tube 20 is inserted into the hole portion 11 of the housing 10, and when an open end portion 24 is press-fitted and held on a projecting portion 17 of the housing 10, the engagement portion 25 is engaged with a retaining surface 19 which is the surface of an upper wall portion 14 of the housing 10 exposed to the upper open portion 15 (see FIG. 9).

In the second embodiment of the present invention, in addition to the construction of the first embodiment, the engagement portion 25 of the tube 20 is engaged with the retaining surface 19 of the housing 10, thereby preventing the tube 20 from forward displacement against a force pushing the tube 20 forward (for example, a force of a spring 40 urging a pin 30), and the stable holding can be effected. And besides, the retaining surface 19 is defined by the upper open portion 15, and this upper open portion 15 is a secondary element which is required for a mold so that it can form the projecting portion 17 on the housing 10 as described above, and by using this, the holding structure is added.

The above embodiments are one example of the present invention, and can be suitably modified and changed within the scope of the appended claims.

What is claimed is:

1. A spring connector comprising:

an electrically-conductive pin;

an electrically-conductive tube, having the pin slidably received therein, the tube holding the pin in such a condition that at least part of the pin projects from one end of the tube in a first direction, and the other end of the tube being open; and a housing, including a hole portion which can receive the tube, and a slit exposing at least part of an outer peripheral surface of the tube to an exterior, the housing having a first wall portion opposed to the other end of the tube and formed with a projecting portion projecting in the first direction and fitting to the other end of the tube, wherein the at least part of the outer peripheral surface of the tube which is exposed from the slit is electrically connectable to a board.

2. The spring connector according to claim 1, wherein an outer diameter of the projecting portion is larger than an inner diameter of the other end of the tube.

3. The spring connector according to claim 1, wherein the projecting portion has a cylindrical shape.

4. The spring connector according to claim 1, further comprising a spring member, received within the tube, one end of the spring member abutting against the projecting portion, and the other end of the spring body urging the pin in the first direction.

5. The spring connector according to claim 1, wherein the slit extends in the first direction, and opposite sides of the slit are chamfered along the first direction.

6. The spring connector according to claim 1, wherein the housing has a second wall portion which is perpendicular to the first wall portion and is opposed to the slit, and an open portion is formed in the second wall portion at a position opposed to the projecting portion.

7. The spring connector according to claim 1, wherein an engagement portion for engagement with a predetermined portion of the housing is formed on the outer peripheral surface of the tube.

8. The spring connector according to claim 1, wherein the housing has a second wall portion which is perpendicular to the first wall portion and is opposed to the slit, an open portion is formed in the second wall portion at a position opposed to the projecting portion, a radially-projecting engagement portion is formed on the outer peripheral surface of the tube, and the engagement portion is engaged with a predetermined surface of the second wall portion defined by the open portion.

* * * * *